US009343215B2

(12) United States Patent
Agarwal et al.

(10) Patent No.: US 9,343,215 B2
(45) Date of Patent: May 17, 2016

(54) SOLENOID INCLUDING A DUAL COIL ARRANGEMENT TO CONTROL LEAKAGE FLUX

(71) Applicant: LABINAL, LLC, Denton, TX (US)

(72) Inventors: Archit Agarwal, Rajasthan (IN); Christopher Kenneth Wyatt, Bradenton, FL (US)

(73) Assignee: LABINAL, LLC, Denton, TX (US)

( * ) Notice: Subject to any disclaimer, the term of this patent is extended or adjusted under 35 U.S.C. 154(b) by 0 days.

(21) Appl. No.: 14/482,406

(22) Filed: Sep. 10, 2014

(65) Prior Publication Data

US 2015/0070116 A1 Mar. 12, 2015

Related U.S. Application Data

(60) Provisional application No. 61/876,814, filed on Sep. 12, 2013.

(51) Int. Cl.
*H01F 3/00* (2006.01)
*H01F 7/16* (2006.01)

(52) U.S. Cl.
CPC ..... *H01F 7/1607* (2013.01); *H01F 2007/1692* (2013.01)

(58) Field of Classification Search
CPC ..... H01F 7/1805; H01F 7/16; H01F 7/1607; H01F 2007/1692
USPC ..... 335/220, 256
See application file for complete search history.

(56) References Cited

U.S. PATENT DOCUMENTS

| | | | | |
|---|---|---|---|---|
| 3,402,280 | A | 9/1968 | Grigg | |
| 6,213,445 | B1 | 4/2001 | Sato et al. | |
| 7,132,920 | B2 | 11/2006 | Hans et al. | |
| 2010/0051841 | A1 | 3/2010 | Herbert et al. | |
| 2012/0218063 | A1 | 8/2012 | Okada et al. | |
| 2013/0241675 | A1* | 9/2013 | Simonin | H01H 50/44 335/6 |

OTHER PUBLICATIONS

International Search Report filed in PCT/US2014/054935 mailed Dec. 19, 2014.

* cited by examiner

*Primary Examiner* — Bernard Rojas
(74) *Attorney, Agent, or Firm* — Rankin, Hill & Clark LLP

(57) ABSTRACT

A solenoid includes a magnetic frame, a bobbin having a length, a hold coil, a pick up coil having a length, a fixed pole, a movable armature having a length, and a return spring biasing the armature away from the pole. The solenoid includes a pick up state when the armature and the pole are separated by a magnetic gap, and a holding state when the armature and the pole are proximate each other. The pick up coil is wound around the bobbin for a portion of the length of the bobbin and the hold coil is wound around the bobbin for a remaining portion of the length of the bobbin. The length of the pick up coil is about the same as the length of the armature and is less than the length of the bobbin.

14 Claims, 4 Drawing Sheets

SOLENOID INCLUDING A DUAL COIL ARRANGEMENT TO CONTROL LEAKAGE FLUX

BACKGROUND

1. Field

The disclosed concept pertains generally to electromagnetic actuators and, more particularly, to solenoids.

2. Background Information

Electromagnetic actuators, such as solenoids, are used for many different applications. A solenoid provides an electromagnetic force in response to electrical power applied to its terminals, Solenoids can include an air core or an iron core. In iron core solenoids, a magnetic frame cooperates with magnetic flux produced by a coil in order to provide a closed, low reluctance magnetic path for the magnetic flux. The coil is wound on a bobbin and mounted inside the magnetic frame. Solenoids also include a moving core or armature and a fixed core or pole. The magnetic flux completes a path from the pole through a magnetic gap to the armature to the magnetic frame and back to the pole. In this complete travel of the magnetic flux, there is some amount of magnetic flux (i.e., a leakage flux) which does not reach the armature. This leakage flux is wasted and cannot contribute toward producing a magnetic force. Therefore, for effective and efficient use of solenoids, the amount of leakage flux should be minimized, in order that the magnetic force can be maximized.

Referring to FIG. 1, a solenoid 2 includes a magnetic frame 4, a hold coil 6, a pick up coil 8, a bobbin 10, a fixed core (pole) 12, a moving core (armature) 14, a return spring 16 and a plunger 18. Solenoids, such as the solenoid 2, have two extreme positions including a first position (or pick up state) when the armature 14 and the pole 12 are separated by a maximum possible gap (or magnetic gap 20 of FIGS. 1 and 2), and a second position (or holding state) when the armature 14 and the pole 12 are proximate (e.g., almost touching) each other (as shown in phantom line drawing in FIG. 1). The solenoid pick up state occurs when an electrical power supply (not shown) is not provided to the coil terminals (not shown) for the hold coil 6 and the pick up coil 8. After the electrical power supply is provided to the coil terminals in the pick up state, the coils 6,8 carry some amount of current depending upon the solenoid state, the coil impedance and the number of coil winding turns. The number of turns (N) and the current (I) carried by the coils 6,8 determine the total NI across the coil terminals. The amount of NI across the coils 6,8 and the magnetic gap 20 determine the value of the magnetic flux in the solenoid 2.

The pick up coil 8 and the hold coil 6 can be wound either in series or in parallel. Normally, there is no electrical connection between the coils 6,8 in the solenoid 2, and they are electrically connected in series or in parallel through an "economizer" circuit (not shown). A suitable "economizer" or "cut-throat" circuit (not shown) can be employed to de-energize the pick up coil 8 in order to conserve power and minimize heating in the solenoid 2 in the holding state. The economizer circuit can be implemented by a timing circuit (not shown) which pulses the pick up coil 8 only for a predetermined period of time, proportional to the nominal armature operating duration. This is achieved by using a dual coil arrangement in which there is a suitable relatively low resistance circuit or coil and a suitable relatively high resistance circuit or coil in series with the former coil. Initially, the economizer circuit allows current to flow through the low resistance circuit, but after a suitable time period, the economizer circuit turns off the low resistance path. This approach reduces the amount of power consumed during static states (e.g., relatively long periods of being energized).

The example winding approach employed in FIG. 1 is such that the pick up coil 8 is wound first across about the entire height (with respect to FIG. 1) of the bobbin 10 and then the hold coil 6 is wound over about the entire height (with respect to FIG. 1) of the pick up coil 8.

There is room for improvement in solenoids.

SUMMARY

According to one aspect, a solenoid includes a magnetic frame, a bobbin having a length, a hold coil, a pick up coil having a length, a fixed pole, a movable armature having a length, and a return spring biasing the armature away from the pole. The solenoid includes a pick up state when the armature and the pole are separated by a magnetic gap, and a holding state when the armature and the pole are proximate each other. The pick up coil is wound around the bobbin for a portion of the length of the bobbin and the hold coil is wound around the bobbin for a remaining portion of the length of the bobbin. The length of the pick up coil is about the same as the length of the armature and is less than the length of the bobbin.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with an example solenoid, although the disclosed concept is applicable to a wide range of different solenoids.

The disclosed concept employs a dual coil arrangement in a solenoid for effective and efficient reduction of the amount of leakage flux.

Figure 1:
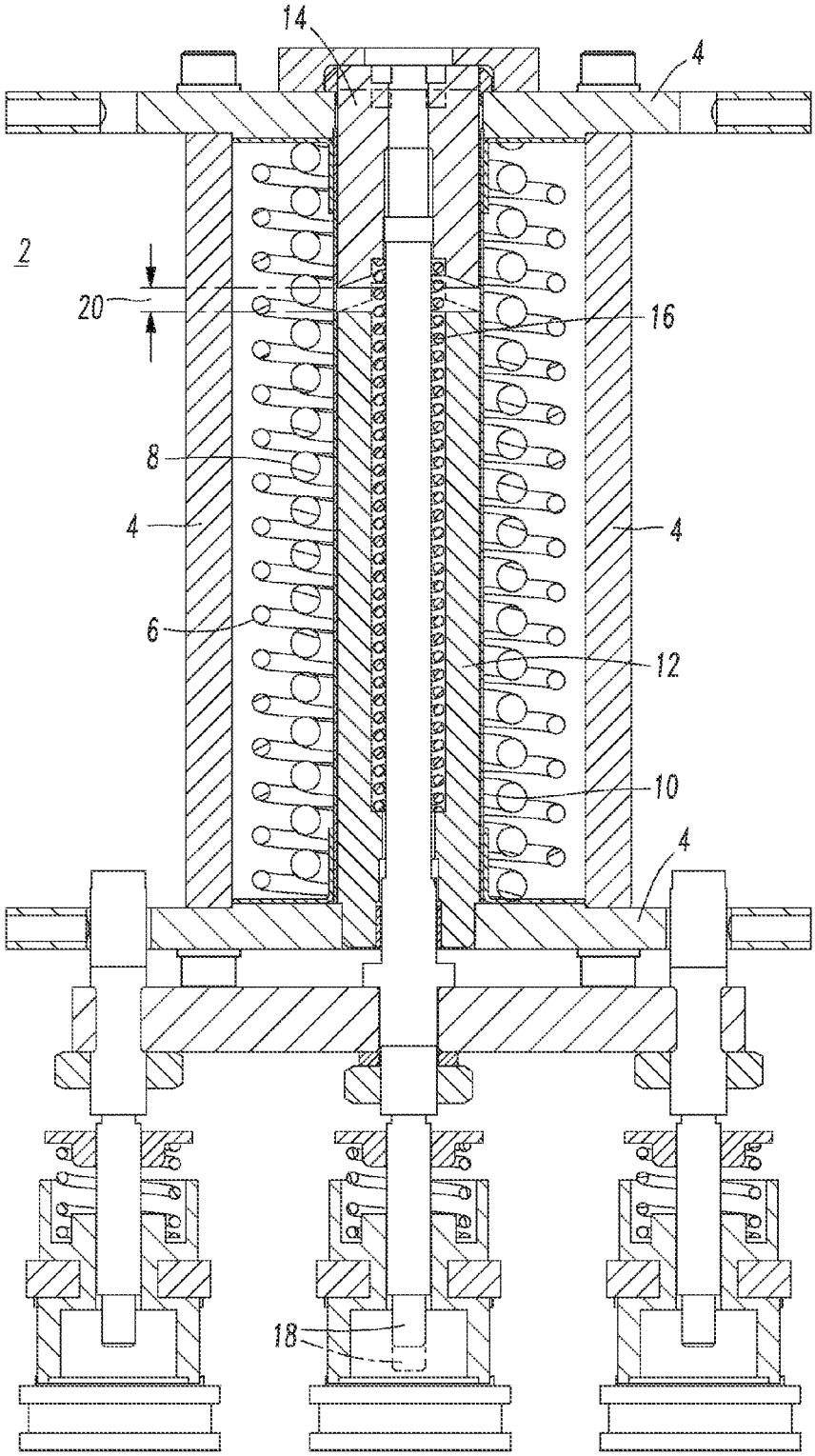
FIG. 1 PRIOR ART
FIG. 1 is a vertical cross-sectional view of a solenoid in which the height of the pick up coil is about the same as the height of the bobbin.
Figure 2:
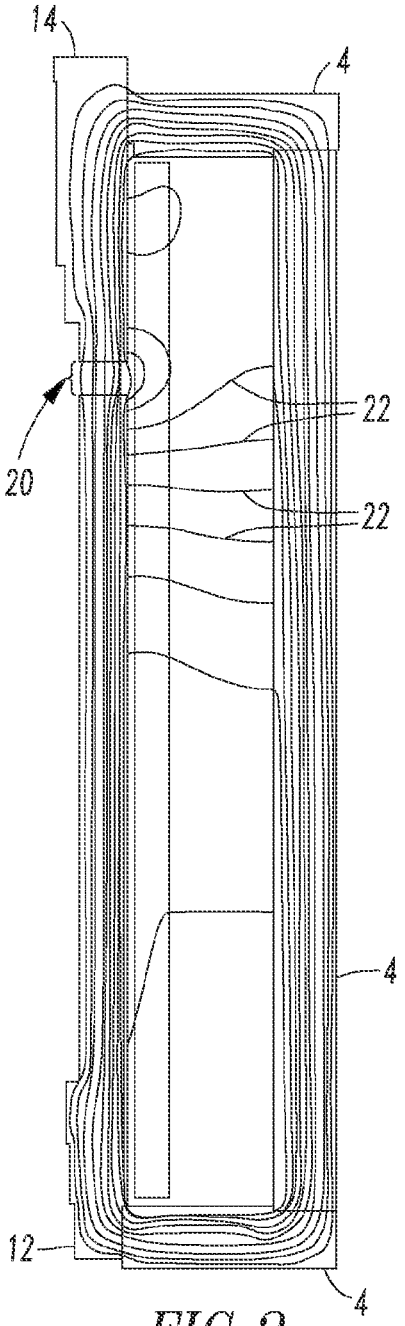
FIG. 2 is a plot showing leakage flux for the solenoid of FIG. 1.

FIG. 2 shows the corresponding flux distribution in the solenoid 2 of FIG. 1. There is a relatively high amount of leakage flux 22 from the pole 12 to the magnetic frame 4. Because of this relatively high leakage flux 22, the useful flux reaching the armature 14 is not sufficient to move the armature towards the pole 12 (since it does not produce sufficient force) which results in a greater NI requirement. The increased requirement of NI for a given number of turns of the coil can be achieved by providing more current through the coil (and a higher pick up voltage). This relatively higher leakage flux 22 reduces the overall efficiency and effectiveness of the solenoid 2.

At the start of the travel of the armature 14 in the pick up state, the magnetic gap 20 is maximum which, in turn, results in a maximum reluctance of the corresponding magnetic circuit. The solenoid 2 of FIG. 1 produces the minimum magnetic flux for a given NI in the pick up state which, in turn, results in the minimum magnetic force. In order to produce sufficient NI in the pick up state, the pick up coil 8 has to carry a relatively higher amount of current (resulting in a relatively higher pick up voltage), The magnetic flux completes its path from the pole 12 through the magnetic gap 20 to the armature 14 to the magnetic frame 4 and back to the pole 12. In this complete travel of the magnetic flux, there is some amount of the magnetic flux (i.e., the leakage flux 22 of FIG. 2) which does not reach the armature 14. In the pick up state, the magnetic flux produced by the pick up coil 8 is minimum for a given NI, such that it becomes very important to minimize the amount of flux leakage.

As the armature 14 starts travelling toward the pole 12, the magnetic gap 20 starts to reduce, which results in less magnetic reluctance and more magnetic flux. This phenomenon is valid until the holding state and it gradually reduces the NI needed to hold the armature 14 in the holding state. The amount of flux leakage from the pole 12 to the magnetic frame 4 is more in the pick up state than the holding state since the magnetic gap 20 is reduced in the holding state. As a result, it becomes very challenging to control the leakage flux 22 (FIG. 2) in the pick up state in order to get the desired useful magnetic flux (passing through the armature 14) and the resulting magnetic force. Otherwise, the solenoid 2 will need more NI across the pick up coil 8 to drive the armature 14 if the leakage flux 22 is greater.

There are multiple ways of winding coils around a bobbin. Depending upon the winding approach, the magnetic reluctance for the magnetic flux is changed which, in turn, changes the amount of the leakage flux from the pole to the magnetic frame.

Figure 3:
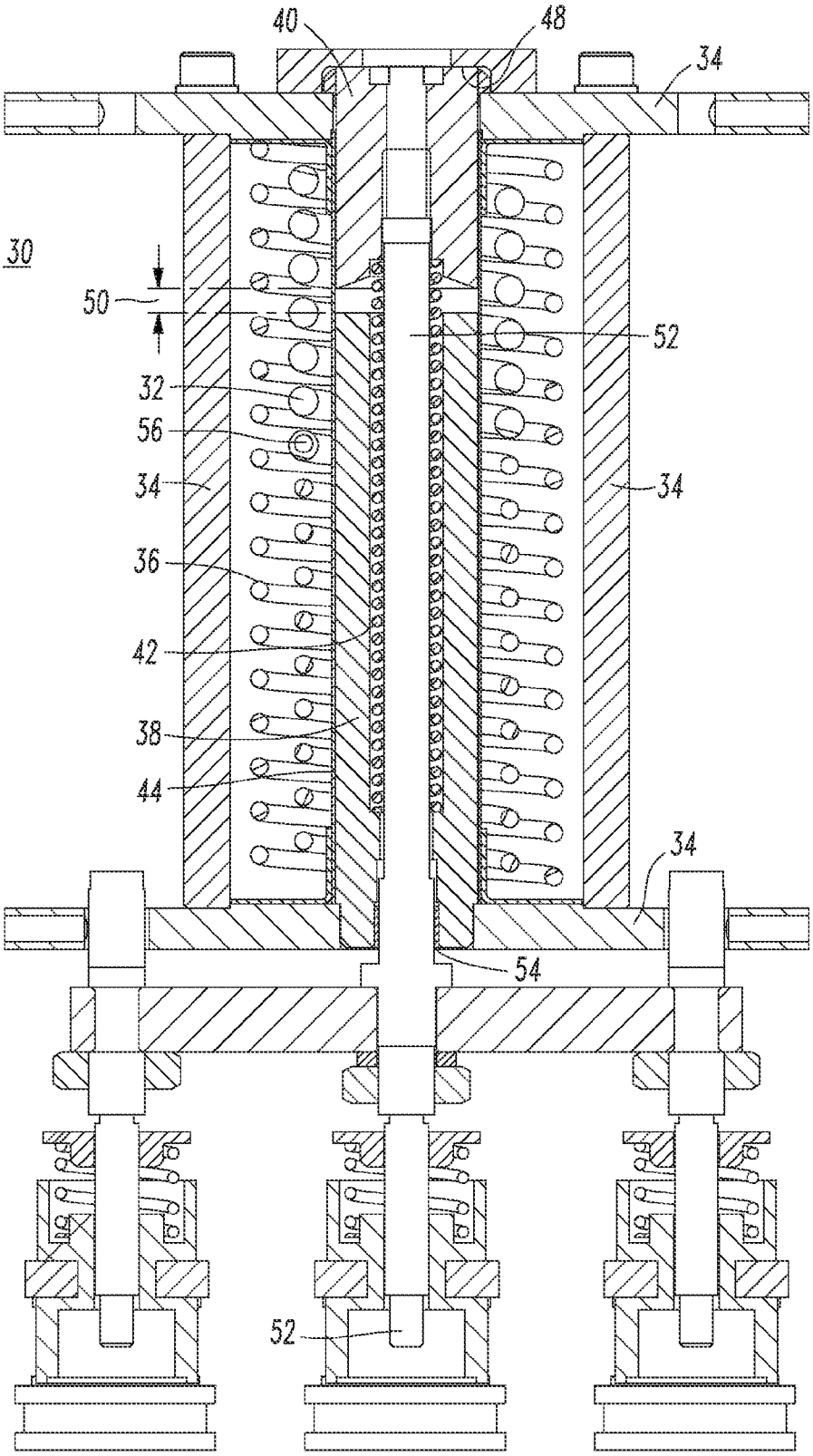
FIG. 3 is a vertical cross-sectional view of a solenoid in accordance with embodiments of the disclosed concept in which the pick up coil is wound near to the armature and the height of the pick up coil is about the same as the height of the armature.

Referring to FIG. 3, in accordance with the disclosed concept, a dual coil arrangement of two direct current (DC) coils 32,36 is employed by a solenoid 30. A first or pick up coil 32 has a relatively low resistance and employs relatively lower AWG coil windings. A second or hold coil 36 has a relatively higher resistance and employs relatively higher AWG coil windings. Initially, in the pick up state, only the pick up coil 32 carries the current, while in the holding state, the electrical power supply (not shown) is switched to the hold coil 36 through a suitable circuit (e.g., without limitation, an economizer electronic circuit, which functions like an RC timer) (not shown). In the pick up state, only the pick up coil 32 carries current; and, in the holding state, either the hold coil or both coils (depending upon the electrical connection in the economizer electronic circuit) carry the current. The solenoid 30 is in a non-energized position (ready for pick up) with a return spring 42 forcing an armature 40 upward (with respect to FIG. 3) to a stop 48 in order to provide the maximum possible gap (Magnetic gap 50 between the armature 40 and pole 38 of FIGS. 3 and 4), There is also a plunger 52 connected to the armature 40 and protruding through an opening 54 in magnetic frame 34.

As a non-limiting example, the relatively low resistance pick up coil 32 has a resistance of about 4.5Ω at 25° C. and NI of 2000 AT (ampere-turns), and the relatively high resistance hold coil 36 has a resistance of about 40Ω at 25° C. and NI of 4100 AT.

For efficient operation of a solenoid, such as the solenoid 30 of FIG. 3, a maximum flux should pass through its armature 40 in order that the magnetic force on such armature 40 can be maximized with a given NI. Since there is relatively more leakage flux 46 (FIG. 4) in the pick up state than the holding state because of the greater magnetic gap 50, the position of the pick up coil 32 with respect to the armature 40 is very important. Hence, the pick up coil 32 is preferably wound as close as possible to the armature 40 in order to minimize the leakage flux.

The solenoid 30 of FIG. 3 employs a dual coil arrangement in order to improve efficiency. The pick up coil 32 is first placed around the bobbin 44 for a portion of its height (with respect to FIG. 3) but not across the complete height (with respect to FIG. 3) of the bobbin 44. Then, the hold coil 36 is placed below the bottom end 56 (with respect to FIG. 3) of the pick up coil 32 in the remaining space across the bobbin height (with respect to FIG. 3). Finally, the remaining turns of the hold coil 36 are wound across the complete height (with respect to FIG. 3) of the bobbin 44 after the hold coil 36 and the pick up coil 32 come to the same radial level.

Figure 5:
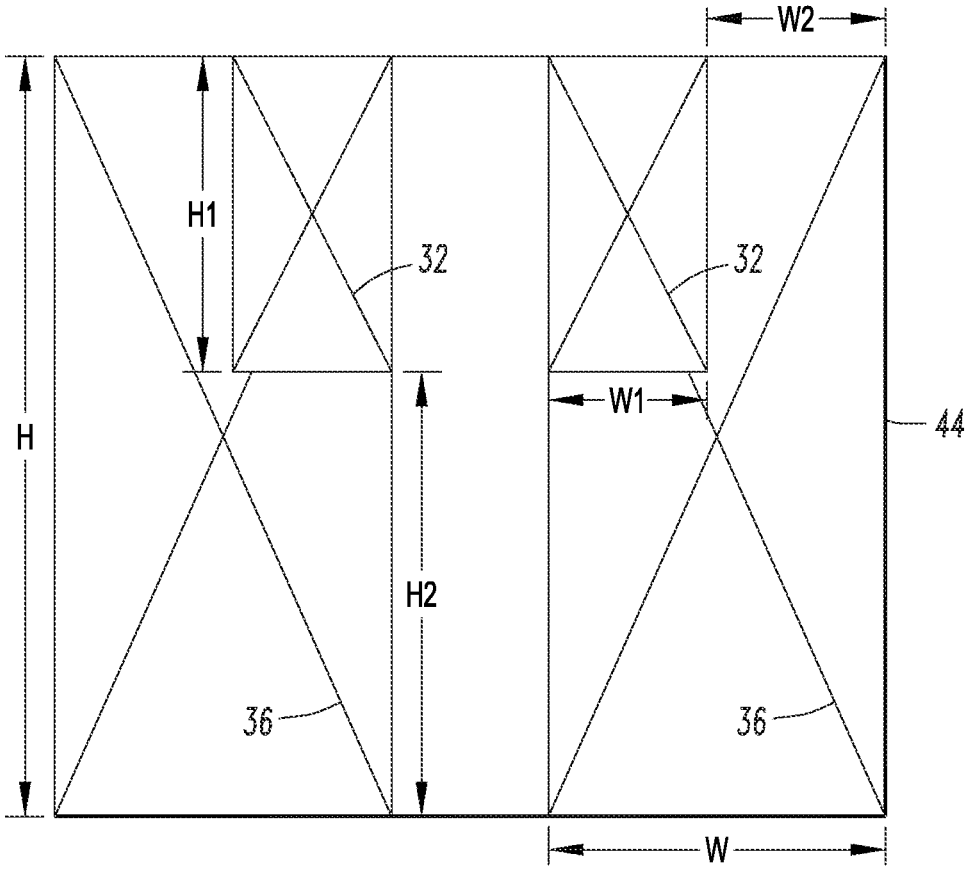
FIG. 5 is a simplified cross-sectional view of the bobbin, pick up coil and hold coil of FIG. 3.

This can be understood from FIG. 5 and from the following non-limiting example. If the available width (W) in the bobbin 44 for the coil windings is 1.2 in. and the available height (H) is 1.3 in., then the pick up coil 32 is wound across a height (H1) of 0.5 in. and a width (W1) of 0.7 in. (e.g., without limitation, depending on the number of turns, the coil current, the coil resistance and the winding AWG). Then, the hold coil 36 is wound for the remaining height (H2=H−H1) of 0.8 in. (i.e., 1.3 in.−0.5 in. in this example) and a width (W1) (i.e., 0.7 in. in this example) equal to the width (W1) of the pick up coil 32, After this, the remaining turns of the hold coil 36 are wound across the complete height (H) of 1.3 in. and the remaining width (W2=W−W1) of 0.5 in. (i.e., 1.2 in.−0.7 in. in this example).

Figure 4:
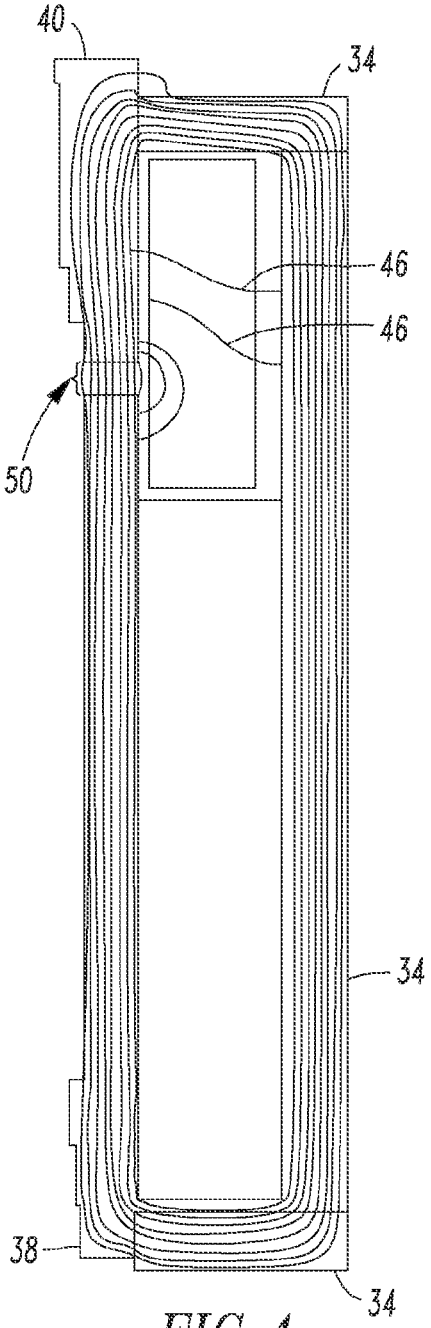
FIG. 4 is a plot showing leakage flux for the solenoid of FIG. 3.

The flux plot for the solenoid 30 of FIG. 3 is shown in FIG. 4. Here, the leakage flux 46 is significantly improved with respect to the leakage flux 22 of FIG. 2. Reduction in the leakage flux 46 results in relatively more magnetic flux passing through the armature 40 which, in turn, provides relatively more magnetic force on the armature 40. As a result, the solenoid 30 needs relatively less NI in order to operate which results in a relatively lower pick up voltage.

The height (with respect to FIG. 3) of pick up coil 32 around the bobbin 44 may vary depending upon the desired force on the armature 40 and other factors, such as for example and without limitation, bobbin envelope size, AWG of the coil winding conductors, coil resistance, allowable current through the coils 32,36, number of winding turns, current carried through the coils 32,36, and pick up voltage. Although the height (with respect to FIG. 3) of the pick up coil 32 can vary, it is preferred to wind this coil 32 having a height (with respect to FIG. 3) as close as possible to the height (with respect to FIG. 3) of the armature 40.

The disclosed winding method of the pick up coil 32 and the hold coil 36 around the bobbin 44 reduces the ampere-turns (NI) of each of the coils 32,36 and reduces the pick up voltage of the pick up coil 32. As a result, the solenoid 30 needs less NI to operate, which results in a lower heat loss in the solenoid 30, and reduces the weight and the overall size of the solenoid 30.

The reduction in the leakage flux 46 results in relatively more magnetic flux passing through the armature 40 which, in turn, provides relatively more magnetic force on the armature 40. As a result, the solenoid 30 needs relatively less NI and a relatively lower pick up voltage in order to operate.

While specific embodiments of the disclosed concept have been described in detail, it will be appreciated by those skilled in the an that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A solenoid comprising:

a magnetic frame;

a bobbin having a length;

a hold coil;

a pick up coil having a length;

a fixed pole;

a movable armature having a length; and a return spring biasing the armature away from the pole;

wherein said solenoid includes a pick up state when the armature and the pole are separated by a magnetic gap, and a holding state when the armature and the pole are proximate each other;

wherein the pick up coil is wound around the bobbin for a portion of the length of the bobbin and the hold coil is wound around the bobbin for a remaining portion of the length of the bobbin; and wherein the length of the pick up coil is the same as the length of the armature and is less than the length of the bobbin;

wherein the pick up coil is first wound around the bobbin for a portion of the length of the bobbin but not across the length of the bobbin; wherein the hold coil is wound starting at an end of the pick up coil in a remaining portion of the length of the bobbin; and wherein a remainder of turns of the hold coil are wound across the length of the bobbin after the hold coil and the pick up coil are both wound to a same radial level on the bobbin.

2. The solenoid of claim 1 wherein the pick up coil and the hold coil are wound around the bobbin in order to reduce leakage flux from the pole to the magnetic frame.

3. The solenoid of claim 1 wherein the pick up coil and the hold coil are wound around the bobbin in order to reduce ampere-turns of each of said pick up coil and said hold coil and to reduce pick up voltage of said pick up coil.

4. The solenoid of claim 1 wherein the pick up coil and the hold coil are direct current coils.

5. The solenoid of claim 1 wherein, in the pick up state, only the pick up coil carries current; and wherein, in the holding state, only the hold coil carries current.

6. The solenoid of claim 1 wherein the pick up coil has a first resistance and employs a first American Wire Gauge (AWG) coil winding; and wherein the hold coil has a second higher resistance and employs a second higher AWG coil winding.

7. The solenoid of claim 6 wherein the first resistance of the pick up coil is about 4.5Ω; wherein the pick up coil is structured for about 2000 ampere-turns; wherein the second higher resistance of the hold coil is about 40Ω; and wherein and the hold coil is structured for about 4100 ampere-turns.

8. The solenoid of claim 1 wherein the length of the pick up coil is wound as close as possible to the length of the armature in order to minimize leakage flux from the pole to the magnetic frame.

9. The solenoid of claim 1 wherein the length of the pick up coil around the bobbin depends upon a desired force on the armature, envelope size of the bobbin, American Wire Gauge (AWG) of a winding conductor of the pick up coil and AWG of a winding conductor of the hold coil, resistance of the pick up coil and resistance of the hold coil, allowable current through the pick up coil and allowable current through the hold coil, number of winding turns of the pick up coil and number of winding turns of the hold coil, and pick up voltage of the pick up coil.

10. The solenoid of claim 1, the pick up coil defining a pick up coil width and the pick up coil length, the hold coil including a first portion and a second portion, the first portion of the hold coil defining a first portion width that is equal to the pick up coil width.

11. The solenoid of claim 10, the first portion of the hold coil defining a first portion length, wherein the bobbin length is equal to a sum of the first portion length and the pick up coil length.

12. The solenoid of claim 10, the second portion of the hold coil defining a second portion length, wherein the bobbin length is equal to the second portion length.

13. The solenoid of claim 10, the bobbin defining an available width and the second portion of the hold coil defining a second portion width and a second portion length, wherein the available width is equal to a sum of the pick up coil width and the second portion width.

14. The solenoid of claim 10, the bobbin defining an available width and the second portion of the hold coil defining a second portion width and a second portion length, wherein the available width is equal to a sum of the first portion width and the second portion width.

* * * * *